United States Patent [19]

Dunn

[11] 4,174,548

[45] Nov. 20, 1979

[54] PLUMBER'S APPLIANCE FOR CLEARING DRAINS

[76] Inventor: Richard P. Dunn, 3437 Davies Ave., Cayucos, Calif. 93430

[21] Appl. No.: 868,996

[22] Filed: Jan. 12, 1978

[51] Int. Cl.[2] ..... B08B 9/02

[52] U.S. Cl. ..... 15/104.3 SN; 4/255

[58] Field of Search ..... 15/104.3 R, 104.3 SN, 15/104.3 GR; 4/255, 256, 257

[56] References Cited

U.S. PATENT DOCUMENTS

| | | | |
|---|---|---|---|
| 1,457,198 | 5/1923 | Utley | 15/104.3 G |
| 1,706,315 | 3/1929 | Norton | 4/255 |
| 1,734,206 | 11/1929 | Fisch | 4/256 |
| 1,982,402 | 11/1934 | Shade | 15/104.3 SN |
| 2,244,735 | 6/1941 | Silverman | 15/104.3 SN |
| 2,473,452 | 6/1949 | Scott | 15/104.3 SN |
| 3,031,683 | 5/1962 | Hellwig | 4/257 X |

FOREIGN PATENT DOCUMENTS

| | | | |
|---|---|---|---|
| 1139785 | 2/1957 | France | 15/104.3 SN |

*Primary Examiner*—Edward L. Roberts
*Attorney, Agent, or Firm*—Flehr, Hohbach, Test, Albritton & Herbert

[57] ABSTRACT

A plumber's appliance for clearing drains and the like includes an elongate hollow grip member formed with an opening extending from one end to the other and an elongate operating element such as a flexible snake or retriever tool or the like disposed within the opening to be moved therein. The grip member serves to steady the operating element as the operating element is manipulated. Upon removal of the operating element a force cup carried at one end of the grip member serves to form a plunger.

4 Claims, 6 Drawing Figures

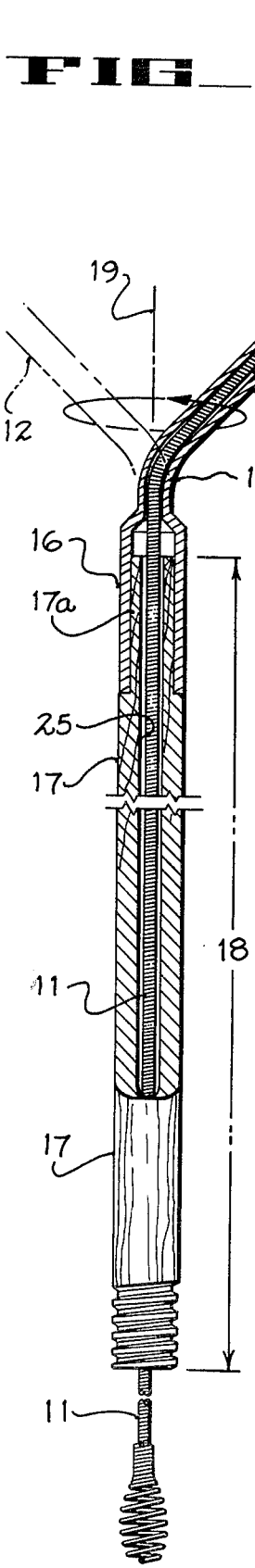
FIG_1
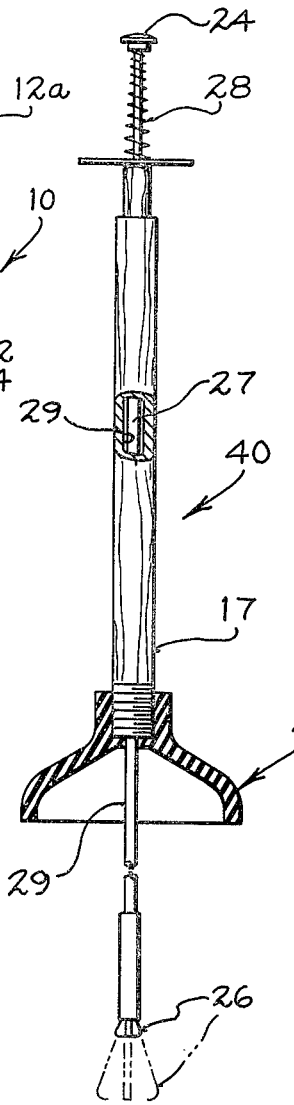
FIG_5
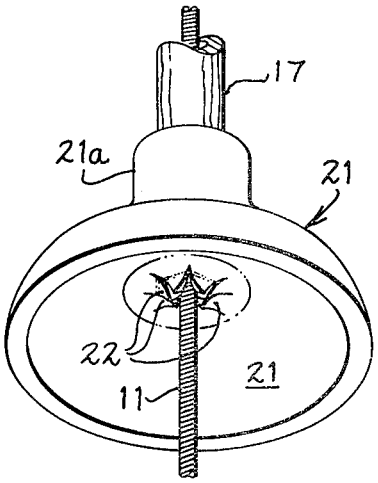
FIG_6
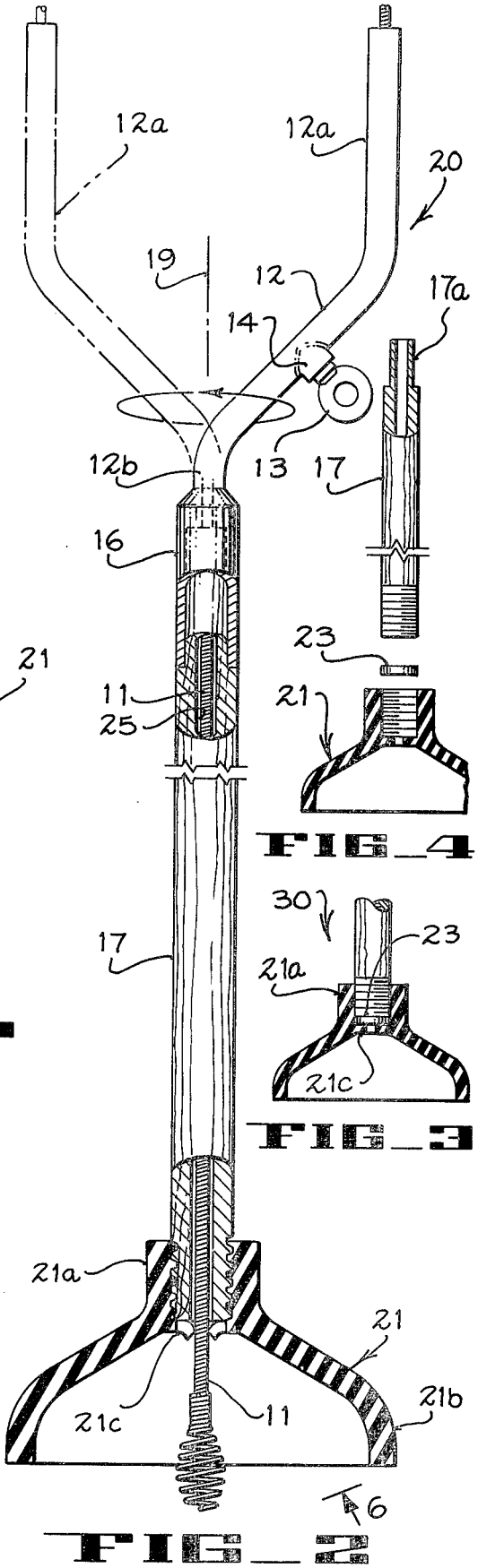
FIG_4
FIG_3
FIG_2

PLUMBER'S APPLIANCE FOR CLEARING DRAINS

BACKGROUND OF THE INVENTION

This invention pertains to plumber's equipment and appliances and more particularly to those appliances employed for clearing drains and the like such as plungers, snakes and remotely operated retriever elements.

Where a drain needs to be cleared out at a remote position from the opening, a so-called "snake" or other elongate flexible clean-out cable formed with an enlarged end is typically employed by inserting the cable and rotating same while urging it forwardly through the drain line. Manipulation of a cable device of this kind is typically relatively difficult for the inexperienced operator since a substantial stretch of the cable remains unrestrained so that the flexible cable does not rotate too readily under the above circumstances. Accordingly, there has been a need for improving the manner of handling an elongate flexible clean-out cable or "snake" as disclosed herein. In addition to the above there has been a need for the provision of an elongate flexible clean-out cable in conjunction with means which serves to apply a plunging action or force to the water within a drain during operation of the cable. Further, apparatus as disclosed herein for supplying the above needs can now also be readily employed to provide a plunger.

SUMMARY OF THE INVENTION AND OBJECTS

In general a plumber's appliance for clearing drains and the like includes an elongate hollow grip member formed with an opening extending from one end to the other. An elongate operating element disposed within the opening moves therein. The grip member serves to steady the operating element as the element is manipulated therein.

It is a general object of the invention to provide an improved plumber's appliance for clearing drains.

It is another general object of the invention to provide means for steadying and handling a stretch of elongate flexible clean-out cable as it is rotated and urged forwardly into a drain.

It is another object of the present invention to provide means in conjunction with the steadying means for permitting the drain to receive applied force in the course of manipulating an elongate operating element in the drain.

Another object of the present invention is to permit use of portions of the foregoing structures to provide a plunger.

The foregoing and other objects of the invention will become more readily evident from the following detailed description of preferred embodiments when considered in conjunction with the drawings.

BRIEF DESCRIPTION OF THE DRAWINGS

FIG. 1 shows an elevation view partially broken away of a plumber's appliance according to the invention;

FIG. 2 shows an elevation view partially broken away of a plumber's appliance according to another embodiment of the invention;

FIG. 3 shows an elevation section view of a third embodiment of the invention;

FIG. 4 shows an elevation view in exploded detail of the embodiment shown in FIG. 3;

FIG. 5 shows an elevation view partially in section according to another embodiment of the invention; and FIG. 6 shows a perspective view taken from beneath in the region of line 6—6 of FIG. 2 showing the central portion of the force cup.

DETAILED DESCRIPTION OF PREFERRED EMBODIMENTS

Referring to FIG. 1, a plumber's appliance 10 for clearing drains and the like comprises an elongate flexible clean-out cable or "snake" 11 arranged to be rotated by means of an elongate rigid hollow handle 12 carried on cable 11. Handle 12 includes first and second axial portions 12*a*, 12*b* offset from each other to permit one of the portions to be gripped and rotated about the axis defined by the other portion.

Means such as the thumb screw 13 disposed to enter a threaded boss 14 serves to connect handle 12 to cable 11 for rotating the cable on the axis 19 of portion 12*b*.

Handle 12 includes an enlarged hollow extension 16 forming a continuation of portion 12*b* adapted to be journal mounted upon a protruding stub portion 17*a* of an elongate rigid hollow grip member 17. Grip member 17 is carried about a stretch 18 of cable 11 for steadying cable 11 on axis 19 of handle portion 12*b* as cable 11 is rotated by handle 12.

In operation, appliance 10 shown in FIG. 1 is employed by holding grip member 17 in one hand and cranking handle 12 in the other. In this way cable 11 can be more readily manipulated without having to contend with the cable flopping in a loose and uncontrolled manner. In addition, as cable 11 is urged inwardly of the drain or other opening additional cable can be supplied from time to time by quickly releasing thumb screw 13, moving handle 12 up stream along cable 11 as desired followed by tightening thumb screw 13 to the cable. The open enlarged extension 16 of handle 12 passes over protruding stub portion 17*a* in a substantially journaled or aligned relation whereby one end of grip member 17 can be considered to carry an aligning means 17*a* for engaging and guiding one of the end portions 12*b* of handle 12 while permitting the other portion 12*a* to be rotated about axis 19.

According to another embodiment 20 as shown in FIG. 2 a resilient force cup 21 threadedly engages exterior threads formed on the lower end of grip member 17. Force cup 21, accordingly can be used for purposes of providing a plunging action at the same time as the flexible cable 11 is being manipulated. Force cup 21 includes a neck portion 21*a* and a bell portion 21*b* with a web portion 21*c* extending transversely of neck portion 21*a*.

Web portion 21*c* is cut into a plurality of pie shaped pieces 22 so as to permit cable 11 to be manipulated through force cup 21 while at the same time forming something of a seal with the side of cable 11 to prevent loss of pressure within force cup 21 inasmuch as the presence of the cuts which are made through web 21*c* serve to cause webs 21*c* to include a flow passage therethrough under pressure.

Thus, the pie shaped pieces 22 lie snugly enough against the elongate operating element, (e.g. cable 11) so as to substantially block fluid flow into the central passage 25 of member 17 via the flow passage defined by the slices cut through web 21*c*.

Accordingly, as shown in FIG. 2 a plumber's appliance 20 has been provided of a kind wherein both a plunging action can be achieved by means of force cup 21 attached to the lower end of grip member 17 while at the same time grip member 17 can serve to steady the stretch 18 of cable 11 therein as the cable is rotated and urged forwardly.

It will be readily appreciated that in the absence of grip member 17 in the embodiments 10, 20 shown in FIGS. 1 and 2 the forward urging of cable 11 must be done substantially as close as possible to the drain. By use of grip member 17 handle 12 can be employed to urge cable 11 forwardly since the cable will be prevented from buckling while contained within grip member 17.

As noted above an elongate operating element such as cable 11 is advantaneously disposed within grip member 17. According to the embodiment 40 shown in FIG. 5 another elongate operating element in the form of a spring loaded retriever tool 24 is movable between advanced and retracted positions for opening and closing claw elements 26 carried on an end thereof. Thus the force cup 21 mounted on the lower end of grip member 17 surrounds claw elements 26 in operation.

By making force cup 21 of clear plastic, operation of the retriever tool 24 can be readily determined visually.

The retriever tool 24 comprises an elongate operating rod 27 urged upwardly by means of spring 28 within an elongate sleeve 29. The lower end of operating rod 27 carries a plurality of radially outwardly spring loaded claw elements 26 whereby upon upward movement of rod 27 they engage the lower end edge of sleeve 29 so as to cause the claw elements 26 to contract radially.

Thus, as shown in FIG. 5 as the force cup 21 is employed for plunging a drain or other opening an elongate retriever tool 24 movable between advanced and retracted positions for opening and closing the claw elements is readily available in the vicinity of the action of force cup 21.

From the foregoing it will be readily evident that there has been provided an improved plumber's appliance.

I claim:

1. A plumber's appliance for clearing drains and the like comprising an elongate flexible clean-out cable, an elongate rigid hollow handle carried on said cable, said handle having first and second portions to be gripped and rotated about the axis of the other said portion for rotating said cable on said axis, an elongate hollow grip member carried about a stretch of said cable for steadying the cable on said axis as said cable is rotated by said handle, a first end of said hollow grip member having aligning means for engaging and guiding said other one of said portions while permitting said one of said portions to be rotated around said axis, a resilient force cup carried from that end of said grip member opposite said first end thereof, said cable being disposed to pass centrally through said force cup, said grip member being movable axially of said stretch of said cable for operating said force cup with said cable disposed axially of said grip member, and means for substantially blocking fluid flow out of said grip member under plunging action of said force cup.

2. In a plumber's applicance comprising an elongate hollow grip member formed with an opening extending from one end to the other, a force cup carried on one end of said member, an elongate operating element disposed within said opening to be moved axially therein, means centrally of said force cup for passing said operating element therethrough while substantially blocking fluid flow out of said grip member via the first named opening under plunging action of said force cup to permit said grip member to be moved between advanced and retracted positions along said operating element while applying a plunging action to said force cup, said operating element comprising an elongate flexible clean-out cable, and further comprising means carried by said cable for rotating said cable in said grip member.

3. In a plumber's appliance comprising an elongate hollow grip member formed with an opening extending from one end to the other, a force cup carried on one end of said member, an elongate operating element disposed within said opening to be moved axially therein, means centrally of said force cup for passing said operating element therethrough while substantially blocking fluid flow out of said grip member via the first named opening under plunging action of said force cup to permit said grip member to be moved between advanced and retracted positions along said operating element while applying a plunging action to said force cup, said operating element comprising an elongate retriever tool movable between advanced and retracted positions for opening and closing claw means carried on the end thereof.

4. A plumber's appliance for clearing drains and the like comprising an elongate flexible clean-out cable and an elongate rigid hollow grip member carried about a stretch of said cable for steadying the cable about its axis while rotating said cable, a resilient force cup carried from an end of said grip member, means centrally of said force cup for passing said cable therethrough while substantially blocking fluid from passing around said cable and out of said grip member under plunging action of said force cup to permit said grip member to be moved between advanced and retracted positions along said stretch of cable while applying a plunging action to said force cup.

* * * * *